US008944432B2

(12) United States Patent
Karikusa

(10) Patent No.: US 8,944,432 B2
(45) Date of Patent: Feb. 3, 2015

(54) SHEET CONVEYING DEVICE AND IMAGE FORMING APPARATUS

(71) Applicant: Yuji Karikusa, Ibaraki (JP)

(72) Inventor: Yuji Karikusa, Ibaraki (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 13/795,893

(22) Filed: Mar. 12, 2013

(65) Prior Publication Data

US 2013/0241141 A1 Sep. 19, 2013

(30) Foreign Application Priority Data

Mar. 16, 2012 (JP) ..... 2012-060442

(51) Int. Cl.

| | |
|---|---|
| ***B65H 9/04*** | (2006.01) |
| ***B65H 9/00*** | (2006.01) |
| ***B65H 5/06*** | (2006.01) |
| ***B65H 7/08*** | (2006.01) |
| ***B65H 9/06*** | (2006.01) |
| ***B65H 9/16*** | (2006.01) |
| ***G03G 15/00*** | (2006.01) |

(52) U.S. Cl.

CPC ..... *B65H 9/00* (2013.01); *B65H 5/062* (2013.01); *B65H 7/08* (2013.01); *B65H 9/004* (2013.01); *B65H 9/06* (2013.01); *B65H 9/166* (2013.01); *G03G 15/6564* (2013.01); *B65H 2403/514* (2013.01); *B65H 2404/1424* (2013.01); *B65H 2511/216* (2013.01); *B65H 2511/222* (2013.01); *B65H 2701/1311* (2013.01); *G03G 15/6567* (2013.01)

USPC ..... 271/246; 271/254

(58) Field of Classification Search

USPC ..... 271/226, 227, 229, 230, 241, 242, 245, 271/246, 253–255

See application file for complete search history.

(56) References Cited

U.S. PATENT DOCUMENTS

| | | | | |
|---|---|---|---|---|
| 4,873,183 | A | 10/1989 | Tachibana et al. | |
| 7,681,882 | B2 * | 3/2010 | Yu et al. | 271/243 |
| 7,684,749 | B2 * | 3/2010 | Yamane et al. | 399/395 |
| 8,002,261 | B2 * | 8/2011 | Hirose et al. | 271/9.02 |
| 8,020,864 | B1 * | 9/2011 | Tharayil et al. | 271/270 |
| 2005/0035536 | A1 | 2/2005 | Suga et al. | |
| 2008/0296828 | A1 | 12/2008 | Shoji et al. | |

(Continued)

FOREIGN PATENT DOCUMENTS

| | | |
|---|---|---|
| JP | 64-000555 | 1/1989 |
| JP | 05-338865 | 12/1993 |
| JP | 06-234441 | 8/1994 |

(Continued)

*Primary Examiner* — Michael McCullough

(74) *Attorney, Agent, or Firm* — Harness, Dickey & Pierce P.L.C.

(57) ABSTRACT

A sheet conveying device includes a shift unit. The shift unit includes a gate member configured to align a recording medium being conveyed thereto by causing a leading end of the recording medium to abut against the gate member so that part of the recording medium bends to form a curved portion; a pair of registration rollers configured to convey the recording medium aligned by the gate member at a predetermined timing, the pair of registration rollers including a driving roller and a driven roller, the driving roller having a rotating shaft coaxial with a rotational central shaft of the gate member; and a drive transmitting unit configured to transmit rotational drive from a drive unit to the driving roller, the drive transmitting unit being disposed on an end side of the rotating shaft of the driving roller.

11 Claims, 12 Drawing Sheets

(56) References Cited

U.S. PATENT DOCUMENTS

| | | | |
|---|---|---|---|
| 2009/0060609 | A1 | 3/2009 | Watanabe |
| 2011/0316226 | A1 | 12/2011 | Karikusa et al. |

FOREIGN PATENT DOCUMENTS

| | | |
|---|---|---|
| JP | 10-067448 | 3/1998 |
| JP | 2001-335166 | 12/2001 |
| JP | 2005-041604 | 2/2005 |
| JP | 3652094 | 3/2005 |
| JP | 2008-050069 | 3/2008 |
| JP | 2008-230823 | 10/2008 |
| JP | 2008-239340 | 10/2008 |
| JP | 2008-297076 | 12/2008 |
| JP | 2009-057143 | 3/2009 |
| JP | 2009-067569 | 4/2009 |
| JP | 2010-024059 | 2/2010 |
| JP | 2012-030971 | 2/2012 |
| JP | 2012-076907 | 4/2012 |

* cited by examiner

SHEET CONVEYING DEVICE AND IMAGE FORMING APPARATUS

CROSS-REFERENCE TO RELATED APPLICATION

The present application claims priority to and incorporates by reference the entire contents of Japanese Patent Application No. 2012-060442 filed in Japan on Mar. 16, 2012.

BACKGROUND OF THE INVENTION

1. Field of the Invention

The present invention generally relates to a sheet conveying device and an image forming apparatus.

2. Description of the Related Art

In an image forming apparatus, such as a laser printer, sheets, such as transfer paper, loaded in a feeding device are fed off one by one and conveyed onto a transfer position. At the transfer position, a position of a toner image formed on, for example, a photosensitive drum or a photosensitive belt, and a transfer position on the sheet side are aligned with each other, so that the toner image is transferred onto the sheet. After the transfer, the sheet is output as a reproduction having the toner image fixed therein.

With the aim of transferring the image at a correct position relative to the sheet, such an image forming apparatus includes a registration mechanism that aligns a sheet feeding timing with a timing at which the image arrives at the transfer position.

A known configuration for a registration mechanism (for example, Japanese Utility Model Application Laid-open Publication No. S64-000555) includes a gate member disposed, in a sheet conveying direction, upstream of registration rollers used for feeding out a sheet according to a registration timing. The gate member can advance into, or retract from, a sheet conveying path.

In this configuration, conveyance of the sheet is temporarily continued with a leading end of the sheet abutted against the gate member to thereby bend part of the sheet and form a curved portion. This enables the leading end of the sheet in which the curved portion is formed to advance toward a nip between the registration rollers by using an action to extend the curved portion by a shape restoring force of the sheet generated when the gate member retracts from the sheet conveying path.

Use of the shape restoring force of the sheet allows a clamping position of the leading end of the sheet by the registration rollers to be uniform at all times among different sheets. This enables an image position arrival timing and the sheet feeding timing toward the transfer position to be aligned with each other constantly among different sheets that are continuously conveyed.

The configuration that incorporates the gate member requires a gate member that is specially prepared in addition to the registration rollers. This increases the number of components of the sheet conveying device, which complicates a configuration of the sheet conveying device and invites increased cost including assembly.

Another arrangement has been developed in which a registration roller includes a leading end abutment mechanism (for example, Japanese Patent Application Laid-open No. H5-338865). Japanese Patent Application Laid-open No. H5-338865 discloses a configuration that includes a torque limiter interposed in a rotating shaft of the registration roller and a gate member disposed rotatably on the rotating shaft.

In this configuration, the gate member is operatively associated with forward and backward rotation of the registration roller and oscillatable between a position at which a sheet leading end is to be positioned, specifically, a position against which the sheet leading end is abutted, and a position at which the sheet having the leading end abutted against the gate member can be fed off, specifically, a retracted position.

The gate member is operatively associated with rotation of the registration roller in a direction opposite to a sheet feeding direction, thereby oscillating to the position at which to abut against the sheet leading end. The gate member is operatively associated with rotation of the registration roller in a direction of the sheet feeding direction, thereby oscillating to the position retracted from the abutment position. Upon collision with a sheet conveying guide member, the gate member remains stationary at the position with no rotation being transmitted through operation of the torque limiter.

Japanese Patent Application Laid-open No. 2012-030971 discloses a sheet conveying device that includes a registration roller and a gate member disposed coaxially with each other to thereby achieve a simple configuration. The sheet conveying device is capable of aligning the toner image on a recording medium with the transfer position accurately and within a short time, the recording media being conveyed at high speed and at short intervals.

In general, in sheet conveying devices, print skew may not be properly corrected due to, for example, a pair of registration rollers or a gate member being out of a correct mounting position, a warped shaft, and part-to-part variations.

Additionally, an image forming apparatus may be installed on a distorted or warped surface. Such an image forming apparatus may be affected by the improper mounting surface, causing a reference line of a skew correcting mechanism to be distorted relative to an image transfer unit or the image transfer unit itself to be distorted, resulting in image skew.

An error in skew correction may also occur due to wear or a change with time in a supporting member of a shaft of the pair of registration rollers.

The image forming apparatus may also be operated to form an image on top of a sheet on which an image has previously been formed. In such a case, the image originally formed on the sheet may not be square relative to the sheet, specifically, the image may be recorded slantwise relative to the sheet. This requires that an arrangement be made to intentionally give the sheet a predetermined amount of inclination for its conveyance. Such an adjustment is difficult to make, which poses a problem.

Various techniques have been developed that detect and adjust such skew. Japanese Patent Application Laid-open No. 2001-335166, for example, discloses a paper feeding mechanism that includes a paper feeding roller driving shaft disposed in a frame in a manner being inclinable relative to a normal sheet conveying direction and a changeover lever that is capable of adjusting an inclination angle of the paper feeding roller driving shaft, the changeover lever being oscillatably moved to thereby allow sheet conveyance to be performed in a condition of being obliquely supported at any desired angle. In addition, Japanese Patent Application Laid-open No. 2009-057143 discloses a feeding device that similarly adjusts an angle of a roller driving shaft to thereby adjust skew in a recording medium in a direction orthogonal to a conveying direction.

In addition, Japanese Patent Application Laid-open No. 2008-239340 and Japanese Patent Application Laid-open No. 2010-024059 each disclose a conveying device that includes an abutment member (gate member) that blocks a conveying path of a recording medium to thereby allow a leading end of the recording medium to abut thereagainst and opens thereafter the conveying path and a variable unit that varies inclination in a width direction of the abutment member relative to a conveying direction of the recording medium, the abutment member being inclined relative to a registration roller.

The arrangements disclosed in Japanese Patent Application Laid-open No. 2001-335166 and Japanese Patent Application Laid-open No. 2009-57143, although being capable of adjusting the inclination angle of the paper feeding roller driving shaft, have no gate members, which makes it difficult to adjust the sheet feeding timing. The arrangements disclosed in Japanese Patent Application Laid-open No. 2008-239340 and Japanese Patent Application Laid-open No. 2010-24059 do have a gate member and its inclination angle is adjusted; however, the arrangements require a gate member in addition to the registration roller, which increases the number of components of the sheet conveying device. This poses problems of a complicated configuration of the sheet conveying device and increased cost including assembly.

In contrast, referring to Japanese Patent Application Laid-open No. 2012-30971, the sheet conveying device is simply structured for improved productivity by having a unit (shift unit) supporting the gate member and a pair of clamp carriage rollers (a pair of registration rollers). The arrangement disclosed in Japanese Patent Application Laid-open No. 2012-30971 controls movement of the shift unit in an axial direction (a direction orthogonal to the sheet conveying direction) to thereby permit lateral shift motion of the gate member. Nonetheless, the arrangement disclosed in Japanese Patent Application Laid-open No. 2012-30971 poses a problem in that the inclination angle of the gate member cannot be easily adjusted.

Therefore, there is a need to provide a sheet conveying device having an arrangement in which a gate member and a pair of registration rollers are supported by a shift unit with its movement controlled in a direction orthogonal to a sheet conveying direction, the arrangement enabling a simple adjustment of a gate angle, and an image forming apparatus having the sheet conveying device.

SUMMARY OF THE INVENTION

It is an object of the present invention to at least partially solve the problems in the conventional technology.

According to an embodiment, there is provided a sheet conveying device that includes a shift unit. The shift unit includes a gate member configured to align a recording medium being conveyed thereto by causing a leading end of the recording medium to abut against the gate member so that part of the recording medium bends to form a curved portion; a pair of registration rollers configured to convey the recording medium aligned by the gate member at a predetermined timing, the pair of registration rollers including a driving roller and a driven roller, the driving roller having a rotating shaft coaxial with a rotational central shaft of the gate member; and a drive transmitting unit configured to transmit rotational drive from a drive unit to the driving roller, the drive transmitting unit being disposed on an end side of the rotating shaft of the driving roller. The sheet conveying device also includes a shift control unit configured to hold the shift unit so that the shift unit is movable in a direction orthogonal to a conveying direction of the recording medium; and a rotation control unit configured to hold the shift unit so that the shift unit is rotatable about the drive transmitting unit as pivotal center in the conveying direction of the recording medium.

According to another embodiment, there is provided an image forming apparatus that includes the sheet conveying device according to the above embodiment.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
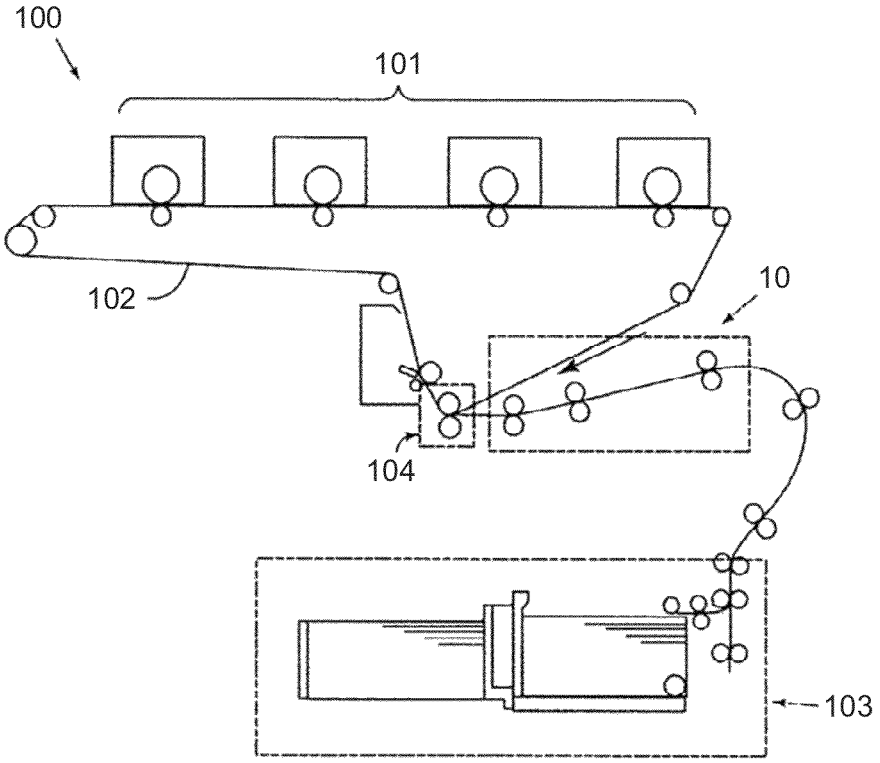
FIG. 1 is a general configuration diagram illustrating an image forming apparatus according to an embodiment of the present invention.

Arrangements according to the present invention will be described in detail below with reference to preferred embodiments of the present invention illustrated in FIGS. 1 to 16.

First Embodiment

A sheet conveying device (10) according to a first embodiment of the present invention includes a shift unit (20). The shift unit (20) includes a gate member (14), a pair of registration rollers (12), and a drive transmitting unit (a first gear 19). Specifically, the gate member (14) causes a leading end of a conveyed recording medium (sheet) to abut against the gate member (14) so that part of the recording medium bends to form a curved portion, thereby aligning the recording medium. The pair of registration rollers (12) includes a driving roller (12A) and a driven roller (12B). The driving roller has a rotating shaft (12*a*) coaxial with a rotational central shaft of the gate member. The pair of registration rollers (12) conveys the recording medium aligned by the gate member at a predetermined timing. The drive transmitting unit is disposed on a first end side of the rotating shaft of the driving roller and transmits rotational drive from a drive unit (40) to the driving roller. The sheet conveying device 10 further includes a shift control unit (for example, a shift unit 20, a fixing guide 24, and a second gear 42) that holds the shift unit movably in a direction orthogonal to a conveying direction of the recording medium and a rotation control unit (for example, a shift unit 20, a fixing guide 24, and a second gear 42) that holds the shift unit rotatably in the conveying direction of the recording medium about the drive transmitting unit as the pivotal center. It is noted that the figures in parentheses denote reference numerals used in the embodiment.

Image Forming Apparatus

FIG. 1 is a schematic diagram illustrating an exemplary image forming apparatus to which a sheet conveying device 10 according to the embodiment of the present invention is applied. The exemplary image forming apparatus illustrated in FIG. 1 is a full-color image forming apparatus including a plurality of image formers disposed along an extended portion of a transfer belt used as a transfer unit.

As illustrated in FIG. 1, this image forming apparatus 100 includes a primary transfer unit, a sheet feeding device 103, a secondary transfer unit 104, and a sheet conveying device (registration unit) 10. Specifically, the primary transfer unit includes an intermediate transfer belt 102 having an extended surface along which image formers 101 of different colors are arrayed in juxtaposition to each other. The sheet feeding device 103 stores therein sheets, such as recording sheets. The secondary transfer unit 104 transfers images in which one is superimposed on another on the intermediate transfer belt all at once onto a sheet fed from the sheet feeding device 103. The sheet conveying device (registration unit) 10 aligns a timing at which the sheet is to be conveyed onto the secondary transfer unit 104 with an image position.

The image formers 101 of a plurality of colors form images through a well-known electrophotography process in which toner images made visible by toner of different colors are superimposed one on top of another and transferred onto the intermediate transfer belt 102. The sheet feeding device 103 feeds a sheet from a cassette loaded with sheets and conveys the sheet toward the sheet conveying device 10.

Sheet Conveying Device

Figure 2:
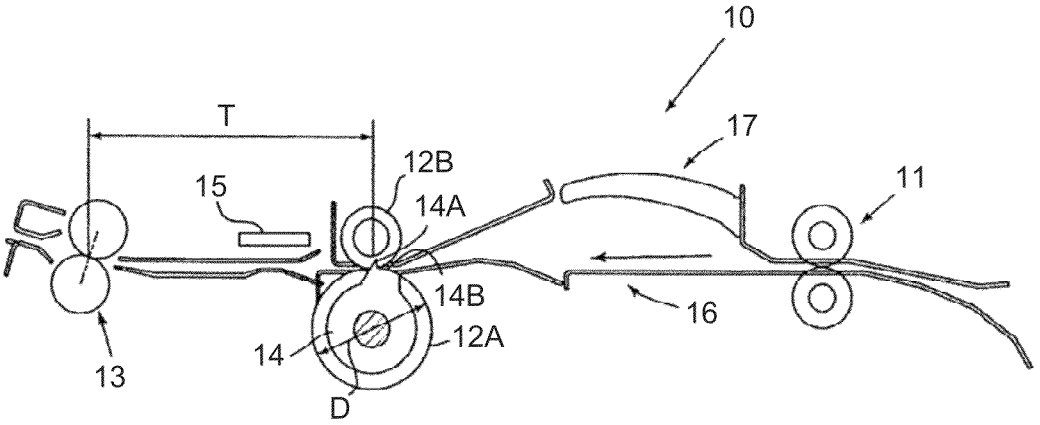
FIG. 2 is a general configuration diagram illustrating a sheet conveying device according to the embodiment of the present invention.

FIG. 2 illustrates a configuration of the sheet conveying device 10. The sheet conveying device 10 includes pairs of paper feeding rollers 11, pairs of registration rollers 12 (each pair including a driving roller 12A, a driven roller 12B), and pairs of timing rollers 13, disposed in this order from an upstream side toward a downstream side in a sheet conveying direction (the direction of an arrow in FIG. 2).

The pairs of paper feeding rollers 11 and the pairs of timing rollers 13 each include a pair of rollers having a substantially identical diameter, disposed across a sheet conveying path. The pairs of paper feeding rollers 11 and the pairs of timing rollers 13 each are fixed in position by a method not illustrated so that the sheet conveying direction extends in parallel relative to each other.

The sheet conveying device 10 further includes gate members 14, each of the gate members 14 being disposed coaxially with the driving roller 12A of each pair of registration rollers 12. The gate member 14 has an abutment surface protruding to the conveying path to thereby cause a conveyed sheet to abut against the abutment surface, thus positioning a leading end of the sheet.

The sheet conveying device 10 further includes a contact image sensor (CIS) 15 disposed downstream of the pairs of registration rollers 12 and upstream of the pairs of timing rollers 13. The CIS 15 serves as a detector that detects a position in a direction orthogonal to the sheet conveying direction.

In addition, a portion of the conveying path between the pairs of paper feeding rollers 11 and the pairs of registration rollers 12 has a lower conveying guide 16 and an upper conveying guide 17. Specifically, the lower conveying guide 16 is disposed substantially in parallel with a tangential direction extended from a nip between each pair of paper feeding rollers 11. The upper conveying guide 17 faces the lower conveying guide 16 and has part of an extension bulging away from the lower conveying guide 16. The bulge of the upper conveying guide 17 is a portion at which a curved portion produced when part of the sheet is bent is located.

Pairs of Registration Rollers/Gate Members

The pairs of registration rollers 12 each include the driving roller 12A (gate side roller) and the driven roller 12B (feeding roller) disposed on the lower side and the upper side, respectively, across the sheet conveying path.

Figure 3A:
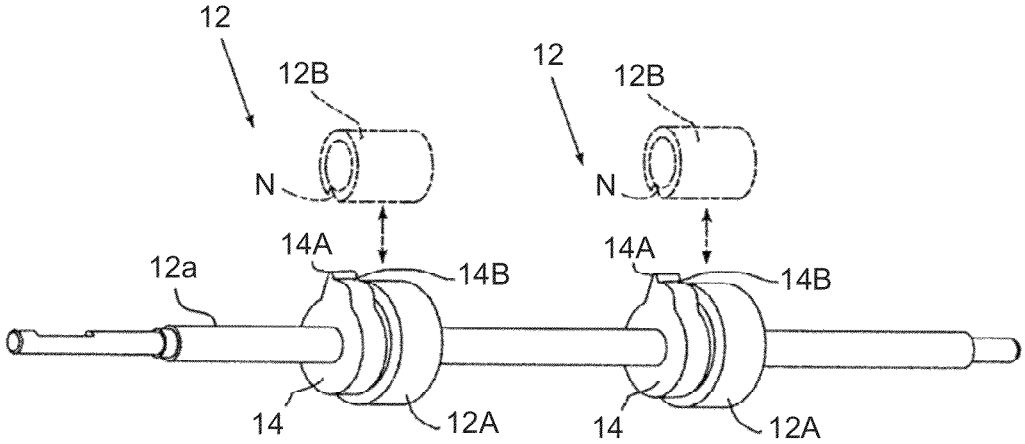
FIGS. 3A and 3B are perspective views illustrating a configuration of pairs of registration rollers and gate members.
Figure 3B:
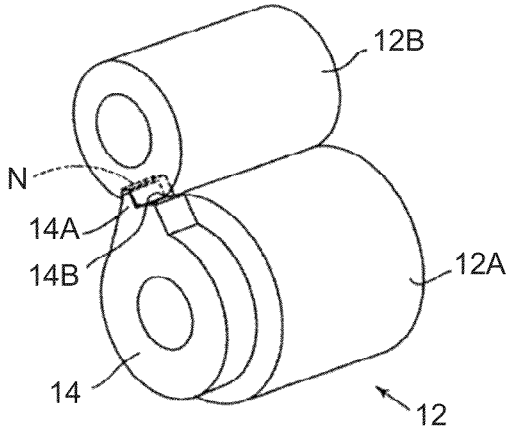

FIGS. 3A and 3B illustrate in detail the driving roller 12A. As illustrated in FIGS. 3A and 3B, the driving roller 12A is provided with the gate member 14 coaxially supported adjacent to the axial end of a roller shaft 12*a*.

Figure 4:
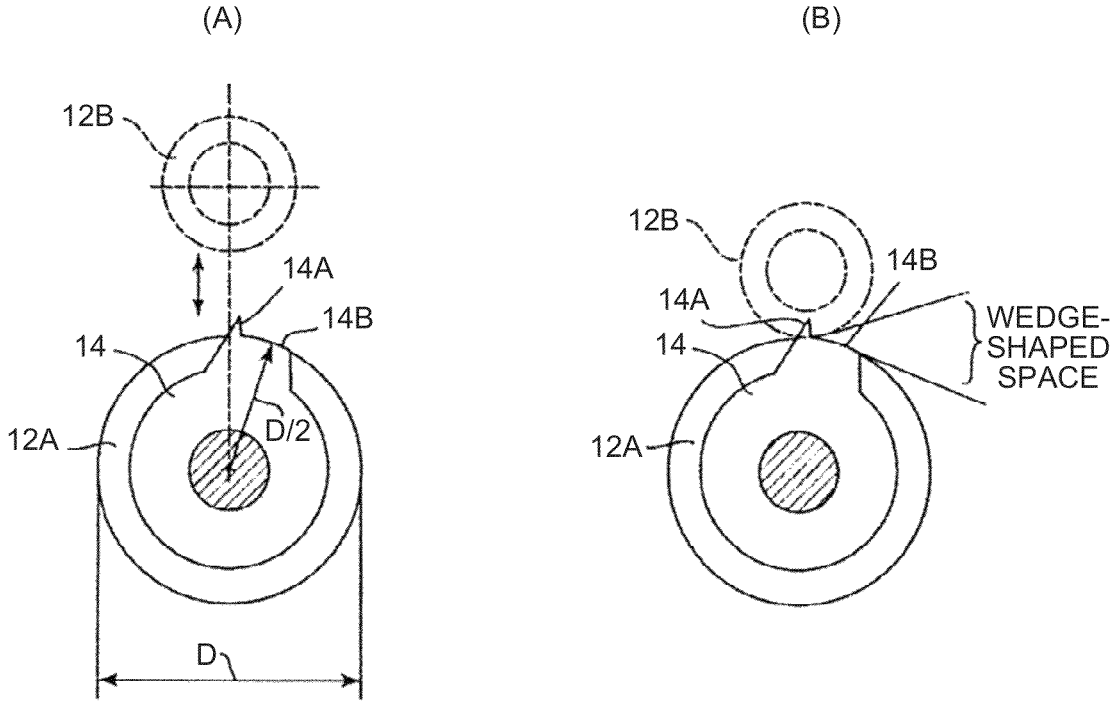
FIG. 4 illustrates cross-sectional views of the configuration of the pairs of registration rollers and the gate members.

As illustrated in FIG. 4, the gate member 14 has a stopper 14A at a part in a peripheral direction thereof. The stopper 14A protrudes to the inside of the sheet conveying path and a leading end of a sheet abuts against the stopper 14A to be stopped. A guide surface 14B is formed on a part continuous with the stopper 14A, the guide surface 14B having an outside diameter identical to that of the driving roller 12A.

As illustrated in (A) of FIG. 4, a condition in which a trailing end of the stopper 14A is disposed on a line that connects the rotational center of the driving roller 12A and that of the driven roller 12B disposed on the side opposite to the driving roller 12A across the sheet conveying path is set as an initial position in which the leading end of the sheet is abutted against and stopped by the stopper 14A. The trailing end of the stopper 14A can be moved to a retracted position to which the trailing end of the stopper 14A is retracted from the sheet conveying path through rotation of the gate member 14.

The leading end of the sheet can abut against the stopper 14A at a position upstream of a nip between the rollers in the sheet conveying direction. The leading end of the sheet can thus be abutted and stopped before entering the nip.

The sheet that is about to enter the nip is therefore yet to be clamped, so that the sheet can be made easy to move for correction of skew that indicates inclination of the sheet. When the leading end of the sheet abuts against the stopper 14A, the sheet bends to be deformed into a curved shape. If the sheet continues to be fed out, moment about the leading end portion in abutment with the stopper 14A causes the sheet to rotate in a direction of eliminating the skew. This results in the entire area of the leading end of the sheet abutting against the stopper 14A, so that sheet skew can be corrected.

The guide surface 14B has the outside diameter identical to that of the driving roller 12A. As a result, referring to (B) of FIG. 4, the guide surface 14B, being positioned upstream of the nip position of the rollers in the sheet conveying direction with the stopper 14A in the initial position, can form a wedge-shaped space with a peripheral surface of the driven roller 12B. This allows the leading end of the sheet advancing toward the pairs of registration rollers 12 to be easily guided toward the nip between the rollers, which achieves a function of facilitating abutment against the stopper 14A.

Preferably, the guide surface 14B is formed with a low friction surface in order for the guide surface 14B to exhibit a function of facilitating guiding also when the leading end of the sheet slidingly moves therealong.

As illustrated in FIG. 3B, the driven roller 12B has a void portion (denoted by N in FIG. 3B) at a part in a peripheral direction thereof, specifically, at a position opposed to the stopper 14A of the gate member 14. The void portion is shaped so as to be opposed to the guide surface 14B in a condition of not interfering with the stopper 14A when the gate member 14 is in the initial position after several rotations through an outside diameter ratio.

Consequently, in addition to the abutment and stop function for the leading end of the sheet achieved by the stopper 14A, the gate member 14 also has a function of enlarging a clamping width relative to the sheet because of the outer peripheral surface of the driven roller 12B being capable of abutting on the guide surface 14B.

Being capable of enlarging the clamping width produces an effect of smoothing movement of the sheet in the width direction, while preventing the sheet from being damaged, specifically, being torn by suppressing concentration of a clamping force during a shift adjustment that means moving the position of the sheet in the width direction.

As illustrated in FIG. 2, the outside diameter of the driving roller 12A in each pair of registration rollers 12 is set as described below with reference to a distance between a nip position between each pair of registration rollers 12 and a nip position between each pair of timing rollers 13.

Let D be the outside diameter of the driving roller 12A in each pair of registration rollers 12 and T be the distance between the nip between each pair of timing rollers 13 and the stopper 14A of each gate member 14 in the initial position. Then, a relationship of $T<\pi D$ holds.

This results in the following. Specifically, the leading end of the sheet reaches the nip position between each pair of timing rollers 13 during one rotation of the driving roller 12A and the sheet continues to be fed out during the time in which a difference is produced between a peripheral length and the distance between the nip positions. The reason for setting such a difference is to allow the leading end of the sheet to reliably reach the nip between each pair of timing rollers 13.

The driving roller 12A is set to rotate continuously in one direction. The driving roller 12A is, however, subject to rotation control so as to be brought to a temporary stop substantially simultaneously when or after the stopper 14A of the gate member 14 reaches the initial position at which the leading end of the sheet is abutted thereagainst and stopped thereby in a rotation process, and so as to start rotating as soon as the leading end of the sheet abuts thereagainst.

Shift Control Unit

A shift adjustment of the sheet will be described below. The shift adjustment refers to moving the sheet in the width direction in order to align an image width central position in a direction perpendicular to the sheet conveying direction with a central position in the sheet width direction (lateral shift). The following describes a configuration of the shift control unit that makes the shift adjustment.

Figure 5:
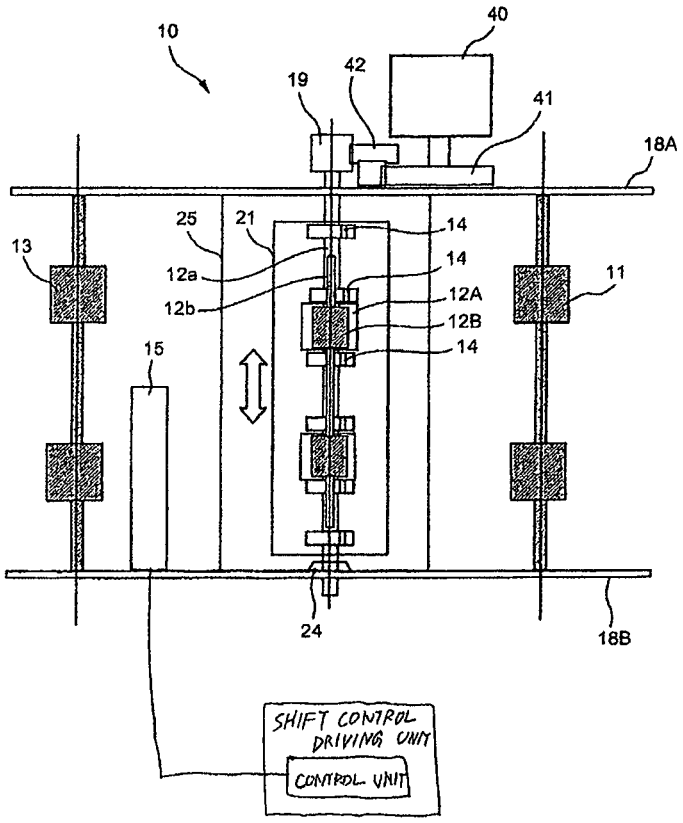
FIG. 5 is a top view illustrating the sheet conveying device.
Figure 6:
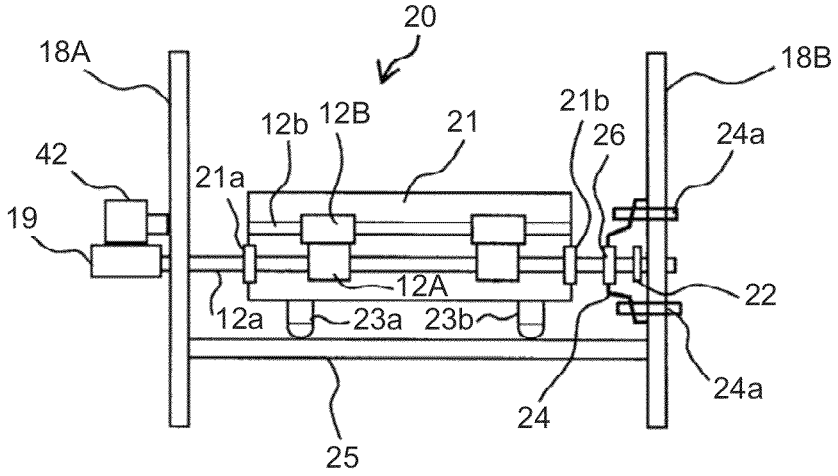
FIG. 6 is a schematic view illustrating the pairs of registration rollers viewed from a downstream side of a sheet conveying path.
Figure 7:
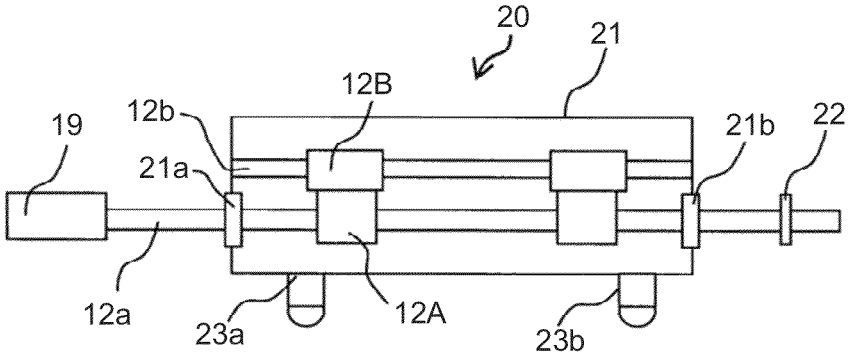
FIG. 7 is a schematic view illustrating members that constitute a shift unit to integrally shift the pairs of registration rollers in an axial direction.

FIG. 5 is a top view illustrating the sheet conveying device 10 illustrated in FIG. 2. FIG. 6 is a schematic view illustrating the pairs of registration rollers 12 viewed from a downstream side of the sheet conveying path. FIG. 7 is a schematic view extracting members that constitute a shift unit 20 to integrally shift the pairs of registration rollers 12 in the axial direction in the schematic view illustrated in FIG. 6.

Each of the pairs of paper feeding rollers 11, the pairs of registration rollers 12, and the pairs of timing rollers 13 of the sheet conveying device 10 has a roller shaft supported in frame side plates 18A, 18B at right and left. It is noted that, in the example illustrated in FIG. 5, the gate members 14 are disposed at a total of six places, specifically, at both axial ends of each driving roller 12A and ends of a shift unit frame body 21 (although omitted in FIGS. 6 and 7).

In addition, a first gear 19 is provided as a drive transmitting part that rotatably drives the shaft 12*a* of the pairs of registration rollers 12 to thereby rotatably drive the driving rollers 12A and the driven rollers 12B. The first gear 19 is a spur gear. It is further noted that the driven roller 12B is supported by a shaft 12*b*.

As illustrated in FIG. 6, the pairs of registration rollers 12 (the driving rollers 12A, the driven rollers 12B, the shafts 12*a*, 12*b*) and the gate members 14 are housed and retained in the shift unit frame body 21 so as to be capable of axially shifting along the shaft 12*a*. It is noted that reference numerals 21*a*, 21*b* denote bearings.

As illustrated in FIG. 7, the first gear 19 and the shaft 12*a* also form part of the shift unit 20, shifting axially. This results in an arrangement in which a second gear 42 that meshes with the first gear 19 exhibits good sliding property.

Preferably, a guide plate 25 is disposed at a lower portion of the shift unit 20. As illustrated in FIG. 6, ball bearings 23*a*, 23*b* disposed on the underside of the shift unit frame body 21 are slidable along the guide plate 25.

Referring further to FIGS. 5 and 6, the shift unit frame body 21 is fixed to the frame side plate 18B of the conveying path via a fixing guide 24 and thereby positioned in the conveying direction. The shift unit frame body 21 is positioned in the direction orthogonal to the conveying direction in a condition of being capable of shifting by a predetermined shift amount.

Figure 8:
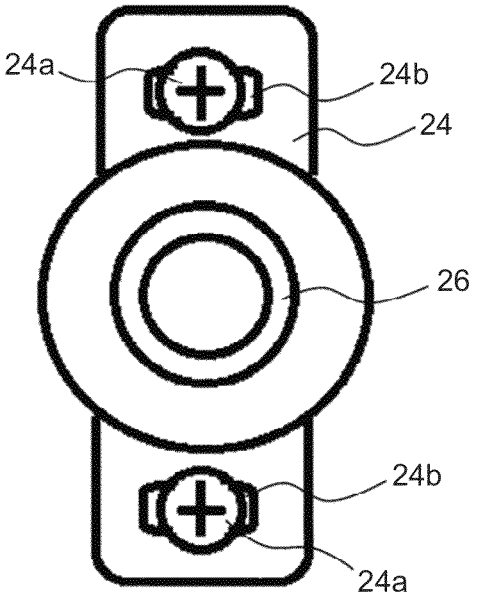
FIG. 8 is a schematic view illustrating an exemplary fixing guide.

FIG. 8 illustrates an exemplary configuration of the fixing guide 24. The fixing guide 24 journals the shaft 12*a* slidably in an axial direction and inclinably through rotation control to be described later with a plain bearing 26. The fixing guide 24 is fixed to the frame side plate 18B with screws 24*a* that are to be tightened in slots 24*b*. The fixing guide 24 can be adjustably moved in the sheet conveying direction according to the shape of the slots 24*b*. The frame side plate 18B has a hole to accommodate therein the shaft 12*a* and threaded holes.

A screw and a spring may, instead, be used to permit adjustment of the position of the shaft 12*a* in the direction orthogonal to the conveying direction through a turning amount of the screw. Alternatively, the frame side plate 18B may have slots in which the fixing guide 24 is adjustably moved in the sheet conveying direction.

Shift Amount Adjustment (1)

The shift amount of the shift control unit can be adjusted to any value desired by a user. The shift amount may be, for example, corrected based on a print result. In this manual adjustment, the shaft 12*a* and the frame side plate 18B (or the fixing guide 24) may, for example, be graduated and the position of the shaft 12*a* may be adjusted to thereby adjust the shift amount of the shift unit 20.

Shift Amount Adjustment (2)

Preferably, a shift control driving unit may also be provided. The shift control driving unit calculates a shift adjustment amount based on a value detected by the CIS 15, thereby driving the shift control unit. The following describes an exemplary shift control driving unit. The shift control driving unit may have any configuration as long as the configuration enables the shift unit 20 to be shifted in the axial direction.

The shift control driving unit may be, for example, configured to include an urging unit (spring) and a cam as described in Japanese Patent Application Laid-open No. 2008-297076 and Japanese Patent Application Laid-open No. 2008-50069.

The shift control driving unit 35 may, for example, include a cam, a shift motor, and a control unit 36. Specifically, the cam is intended to move axially the shift unit 20 that includes the pairs of registration rollers 12 based on a detection result from the CIS 15 for detecting the position of the sheet in the Width direction. The shift motor assumes a driving source for driving the cam. The control unit 36 controls a drive amount of the shift motor based on the detection result from the CIS 15.

The cam driven by the shift motor has a cam profile that results in the shift unit being moved axially. The cam shifts the shift unit 20 axially with an amount corresponding to a rotational phase of the shift motor, so that the center of the sheet in the width direction and the position of the image in the width direction can be adjusted. The required shift amount is calculated based on the position in the direction orthogonal to the sheet conveying direction detected by the CIS 15.

Figure 9:
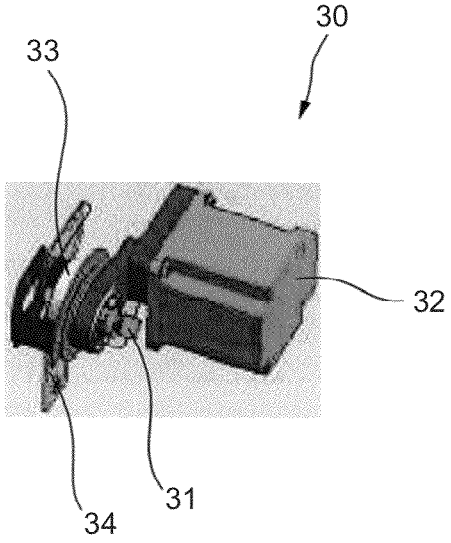
FIG. 9 is a schematic view illustrating an exemplary shift control driving unit.

The shift control driving unit may alternatively be configured, for example, as illustrated in FIG. 9. A shift control driving unit 30 includes a control unit not illustrated, a sensor 31, an eccentric cam 33, and a sensor plate 34. Specifically, the sensor 31 detects a home position of the shift unit 20 and a moving amount corresponding to the adjustment amount calculated by the CIS 15. The eccentric cam 33 is rotated by a driving source (stepping motor) 32. The sensor plate 34 is mounted coaxially with the eccentric cam 33. The sensor plate 34 has a slit for allowing the sensor 31 to detect the moving amount. The eccentric cam 33 is clamped and held between bracket mechanisms (the ball bearings 23*a* and 23*b* in FIG. 6) attached to the shift unit 20. The shift control driving unit 30 can thereby move the shift unit 20 horizontally relative to the conveying direction, as translated from rotation of the eccentric cam 33.

Rotation Control Unit

The following describes adjustment of a gate angle of the shift unit 20, specifically, the pairs of registration rollers 12 and the gate members 14. The sheet conveying device 10 according to the embodiment of the present invention includes the rotation control unit that is capable of rotating the shift unit 20 about a predetermined pivot as a reference. The following describes a configuration of the rotation control unit that adjusts the gate angle.

As illustrated in FIG. 5, the pairs of registration rollers 12 are rotated as follows. Specifically, drive from a motor 40 as a driving source drives a gear train 41 and the gear (called the second gear) 42. Further, the drive of the second gear 42 is transmitted to the first gear 19 mounted coaxially with the pairs of registration rollers 12, thus rotating the pairs of registration rollers 12. It is noted that the first gear 19 and the second gear 42 each are a spur gear.

As illustrated in FIG. 6, the shaft 12*a* of the driving rollers 12A of the pairs of registration rollers 12 is fixed by the bearings 21*a*, 21*b* rotatably relative to the shift unit frame body 21. The shaft 12*a* is further fixed by, for example, the plain bearing 26 slidably relative to the fixing guide 24. In addition, a regulating member 22 that restricts a sliding amount is mounted on the shaft 12*a*.

Figure 10:
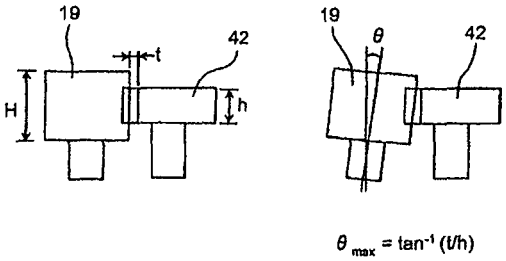
FIG. 10 is a diagram illustrating a rotation control unit.

FIG. 10 is a diagram for illustrating the rotation control unit. The pairs of registration rollers 12 are fixed such that a second end side of the shaft 12*a* is moved in the conveying direction with an engagement portion between the first gear 19 and the second gear 42 as a pivot. This allows the shift unit 20 to be fixed at a position at which the shift unit 20 is moved by a predetermined angle relative to the sheet conveying direction. This allows an abutment surface angle of the gate member 14 (gate angle) to be adjusted to any angle relative to the conveying direction.

The first gear 19 and the second gear 42 are spur gears and the engagement portion therebetween is configured such that there is a sufficient clearance between a tooth tip and a tooth bottom. As illustrated in FIG. 10, the first gear 19 and the second gear 42 are configured such that rotation by a maximum movable angle θmax does not impede meshing engagement among the gear train for transmitting a drive force. Forming the drive transmitting unit with the gears as described above enables the gate angle to be adjusted over a range of the clearance between the gears.

Referring to FIG. 10, let ±θ° be the movable angle range of the shift unit 20, H be the width of the first gear 19, and h be the width of the second gear 42, and if H>h is satisfied, then a relationship between a clearance t between the first gear 19 and the second gear 42 and the maximum movable angle may be given by Equation (1).

$$\theta max = \tan^{-1}(t/h) \quad (1)$$

Figure 11:
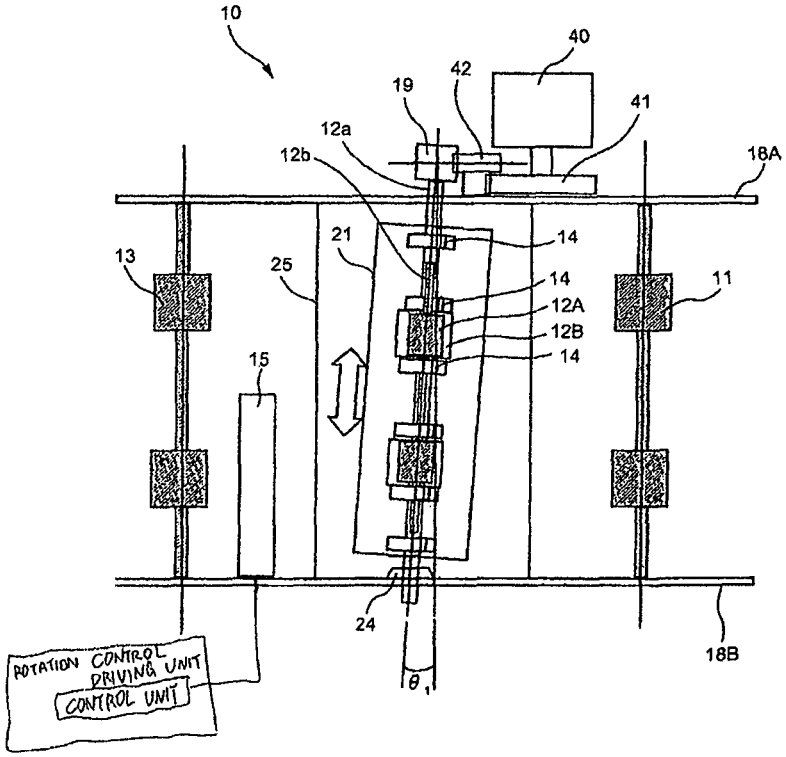
FIG. 11 is a top view illustrating the sheet conveying device during angle adjustment.

Therefore, referring to FIG. 11, movement by an angle $\theta_1$ ($<\theta_{max}$) does not result in the tooth tip and the tooth bottom of the first gear 19 and the second gear 42 contacting each other. Movement of the shift unit 20 by the angle $\theta_1$ does not pose any sliding property problem, enabling a shift operation.

Rotation Angle Adjustment (1)

An angle adjustment amount of the rotation control unit can be adjusted to any value desired by a user. The angle adjustment amount may be, for example, corrected based on a print result. This manual adjustment may be made by, for example, adjusting tightening positions of the screws 24*a* in the fixing guide 24 illustrated in FIG. 8 to thereby change the mounting position of the fixing guide 24 on the frame side plate 18B. This allows the angle adjustment amount of the shift unit 20 to be adjusted. At this time, preferably, the fixing guide 24 is, for example, graduated and the angle adjustment amount can be adjusted. In addition, the plain bearing 26 of the fixing guide 24 allows the shift unit 20 to be subject to shift control in a condition of being rotated.

Rotation Angle Adjustment (2)

Preferably, a rotation control driving unit 37 may also be provided. The rotation control driving unit 37 calculates the angle adjustment amount based on a value detected by the CIS 15, thereby driving the rotation control unit. The rotational control driving unit 37 may include a control unit 38. The rotation control driving unit 37 may, for example, be a mechanism that allows the fixing guide 24 to reciprocate in the sheet conveying direction and to be fixed at any position. A moving mechanism may incorporate, for example, a stepping motor, a gear, and an eccentric cam to adjust displacement and a spring or a stepping motor to fix in position through energization.

Exemplary Sheet Conveyance

Figure 12:
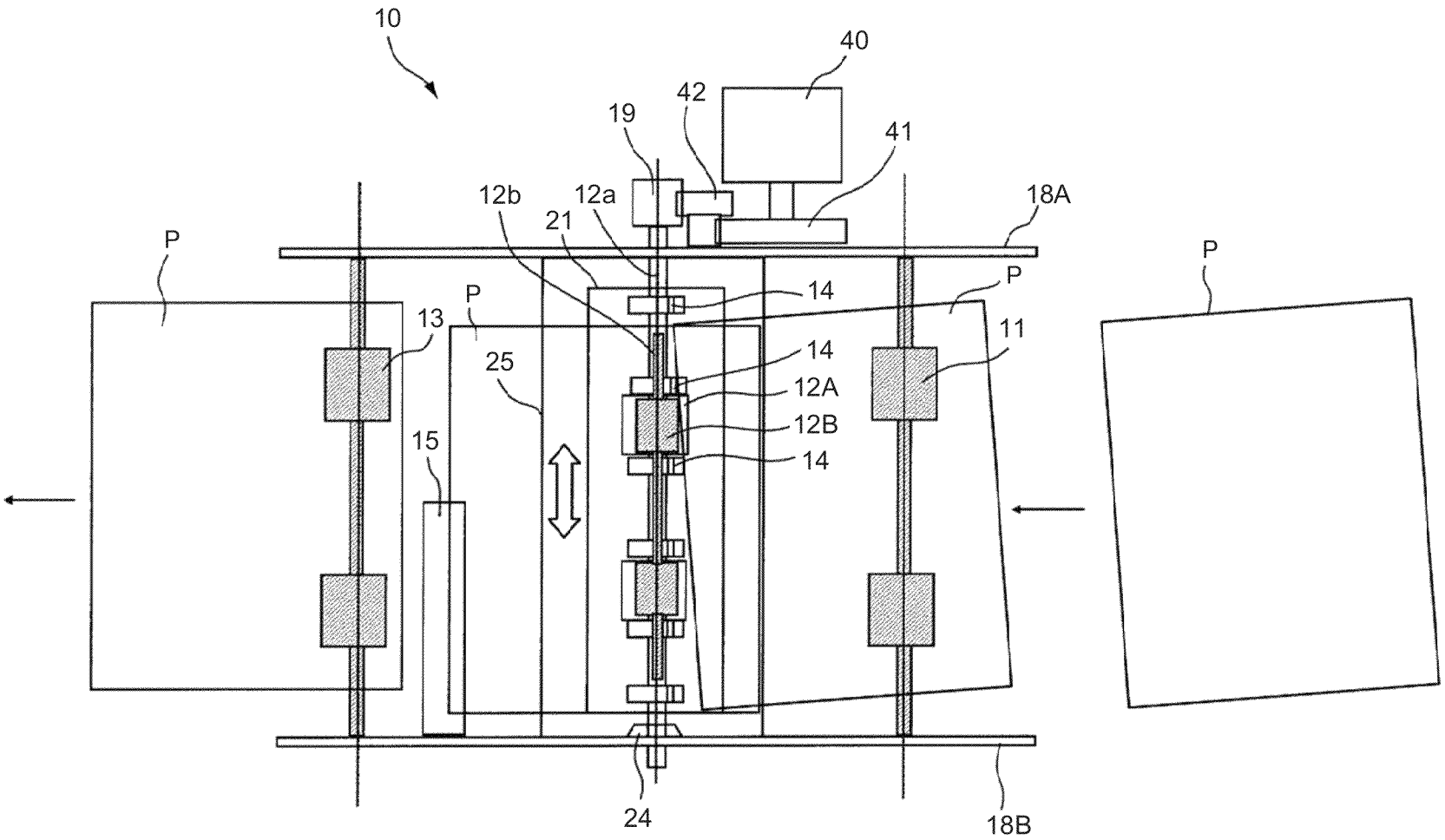
FIG. 12 is a diagram illustrating a method for adjusting skew and a position in a width direction of a sheet fed onto the sheet conveying device.

The following describes exemplary sheet conveyance performed by the sheet conveying device 10 described heretofore. FIG. 12 is a diagram illustrating a method for adjusting skew and a position in the width direction of a sheet fed from the sheet feeding device 103 onto the sheet conveying device 10.

The sheet P conveyed along a conveying path not illustrated is abutted against the gate members 14 by the pairs of paper feeding rollers 11. The sheet P is further fed on and a curved portion is thereby formed therein, which corrects skew and longitudinal registration in the sheet P.

At a predetermined timing thereafter, the gate members 14 and the pairs of registration rollers 12 are simultaneously made to start rotating, so that the sheet P in a corrected attitude is clamped between the pairs of registration rollers 12 and conveyed downstream.

The position in the width direction of the sheet P conveyed downstream is detected by the CIS 15. With the sheet P clamped between the pairs of registration rollers 12, the shift unit 20 is subject to a lateral shift by the shift amount calculated from the detection result of the CIS 15, thereby correcting lateral registration (shift control unit).

Figure 13:
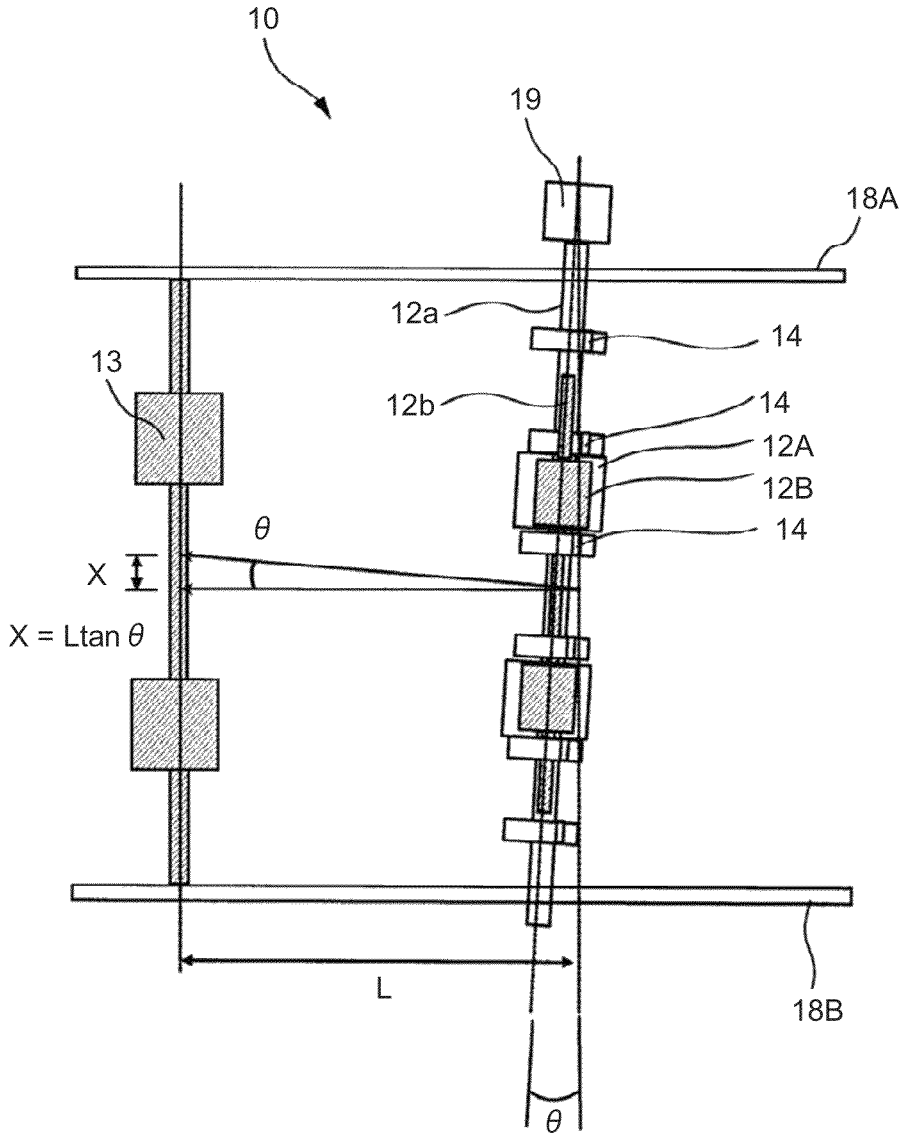
FIG. 13 is a diagram illustrating an axial deviation amount during angle adjustment.
Figure 14:
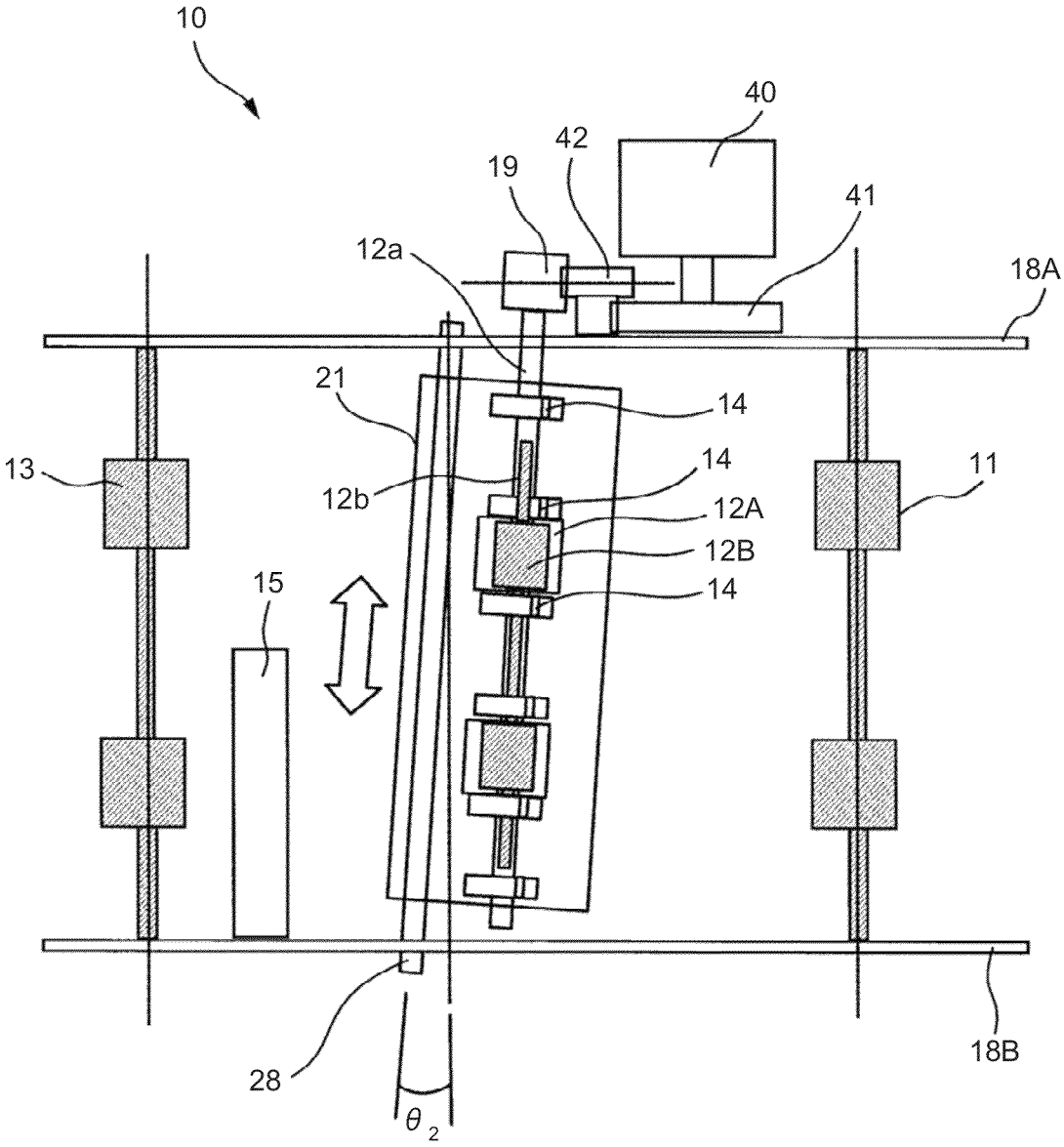
FIG. 14 is a top view illustrating the sheet conveying device during angle adjustment by a shift unit including a shaft.
Figure 15:
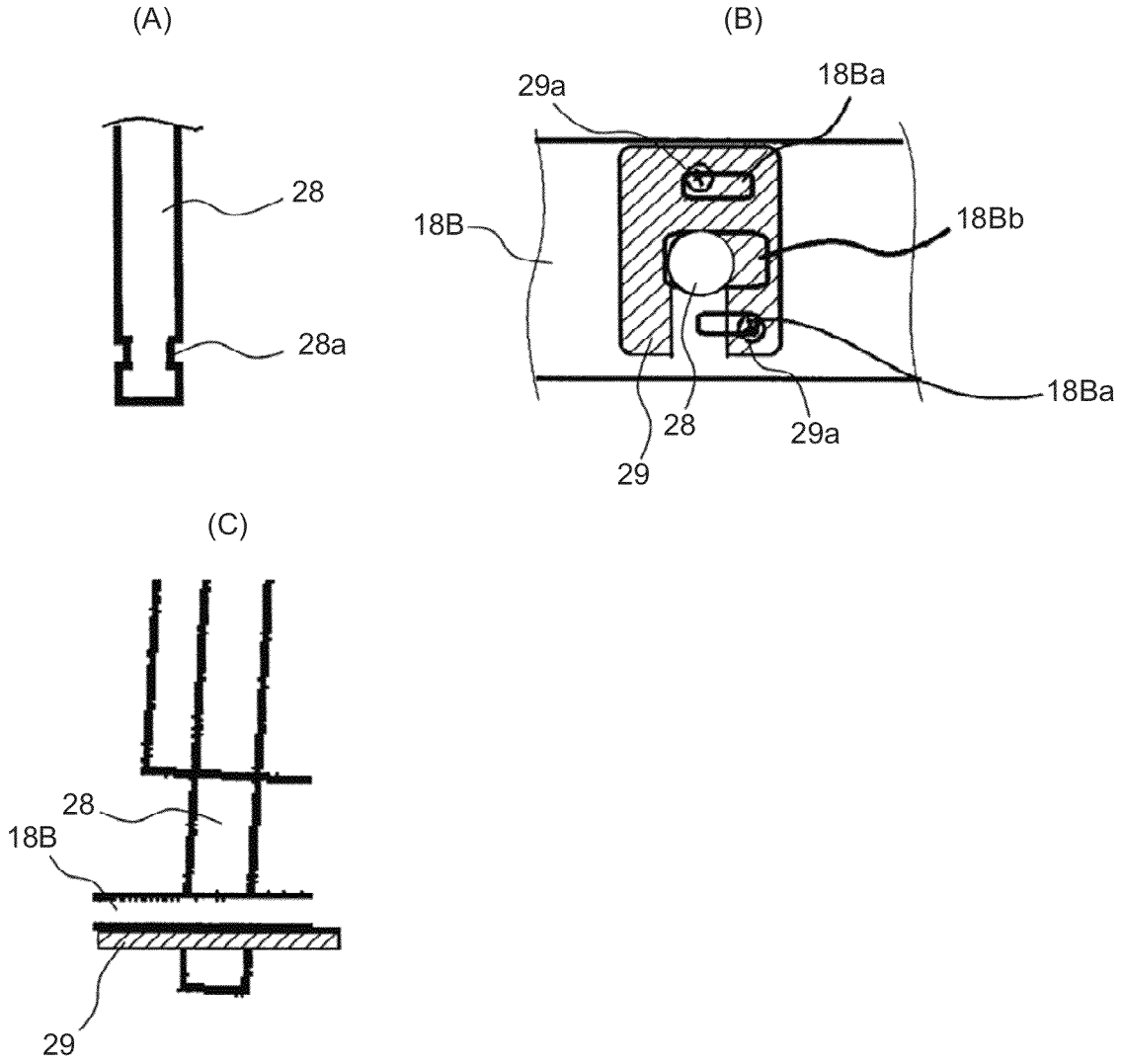
FIG. 15 illustrates a condition in which the shaft is fixed to a frame side plate with a bracket.

Referring to FIG. 13, if the shift unit 20 is angled by θ relative to the conveying direction (rotation control unit), the sheet P is deviated by $X=L\tan\theta$ in the direction orthogonal to the conveying direction during its conveyance from the pairs of registration rollers 12 to the pairs of timing rollers 13. This enables calculation of an optimum shift amount by adding X to what is calculated as the gate angle adjustment amount.

In the sheet conveying device according to the embodiment of the present invention described heretofore, the shift unit that supports the gate members and the pairs of registration rollers can be moved in the direction orthogonal to the sheet conveying direction and the gate angle can be adjusted with a simple configuration.

The shift unit includes the rollers on the drive side and the driven side of the pairs of registration rollers and these rollers on the drive side and the driven side can both be inclined, which eliminates possibility of skew occurring during conveyance.

The gate angle adjustment mechanism makes the adjustment with the drive transmitting unit used as a pivot, thereby achieving an easy adjustment mechanism. A lateral shift operation of the shift unit can also be made even by adjusting the gate angle.

The lateral shift amount, the angle adjustment amount, and the lateral shift amount that incorporates the deviation amount during angle adjustment are obtained based on the detection result of the detector to thereby drive the shift unit. This enables the user to adjust the lateral shift position and the gate angle according as he or she desires.

Second Embodiment

The following describes a sheet conveying device according to another embodiment of the present invention. It is noted that descriptions for similarities to the above-described embodiment will be omitted.

As described in the first embodiment, use of the shaft 12*a* of the pairs of registration rollers 12 as the adjustment shaft achieves a maximum movable angle for the shift unit 20. Meanwhile, referring to FIG. 14, preferably, the sheet conveying device 10 includes, in addition to the pairs of registration rollers 12, a shaft 28 that penetrates the shift unit 20 and can be fixed to the frame side plates 18A, 18B at right and left.

In this case, the gate angle can be adjusted by, for example, moving the shaft 28 in the forward or backward direction of the conveying direction from the outside of the frame side plate 18B, with one end of the shaft 28 as a pivot. In the example illustrated in FIG. 14, a protrusion from the shaft 28 is moved by an angle $\theta_2$ in the conveying direction and then fixed in position.

The shaft 28 may be fixed at a variably adjustable position in the conveying direction in the frame side plate 18B as follows. Specifically, the shaft 28 may have a groove 28*a*, for example, as illustrated in (A) of FIG. 15; a bracket 29 is fitted in the groove 28*a* and the bracket 29 is fixed in the frame side plate 18B with, for example, a screw 29*a* as illustrated in (B) and (C) of FIG. 15; (B) is a side elevational view and (C) is a top view, illustrating a condition in which the shaft 28 is fixed in the frame side plate 18B via the bracket 29. It is noted that, in (B) of FIG. 15, reference numeral 18Ba denotes a threaded hole for the bracket 29 formed in the frame side plate 18B and reference numeral 18Bb denotes a slot in which the position of the shaft 28 can be adjusted.

At this time, preferably, the bracket 29 may, for example, be graduated and the gate angle can be adjusted using the graduations. In addition, similarly to the above-described first embodiment, a rotation control driving unit calculates the gate angle adjustment amount based on a detection result given by a CIS 15 and controls the leading end position of the shaft 28, thereby setting a desired gate angle.

The shift position may be controlled by allowing the shift unit 20 and the shaft 28 to be slidable through, for example, a bearing and the shift amount may thereby be adjusted. Alternatively, the shift amount may still be adjusted as follows: specifically, the shift unit 20 and the shaft 28 are fixedly mounted and the shaft 28 is adapted to have a plurality of grooves 28*a*, so that the bracket 29 is fitted selectively in one of the grooves 28*a*.

Third Embodiment

Figure 16:
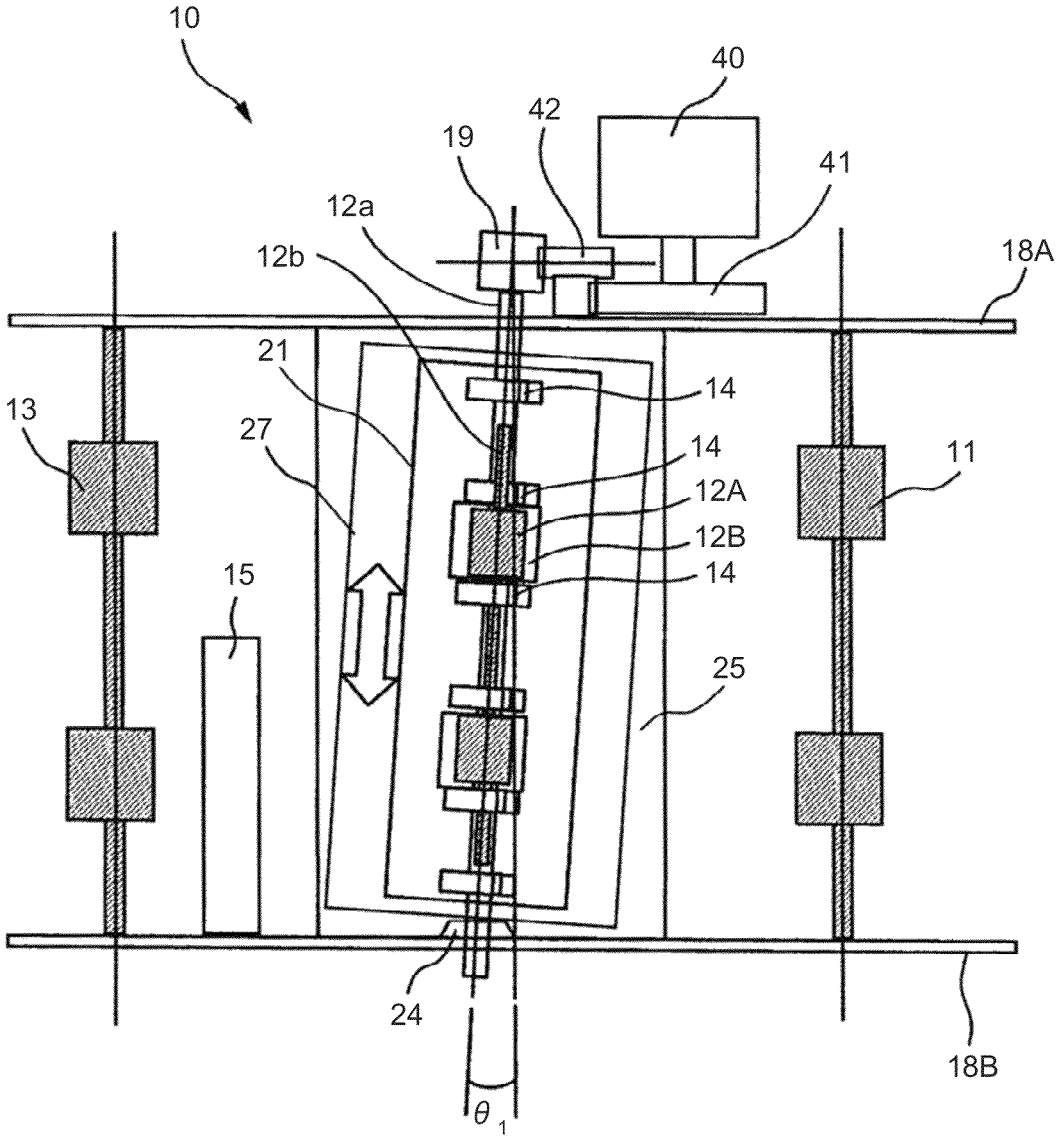
FIG. 16 is a top view illustrating the sheet conveying device during angle adjustment by a shift unit including a rotary plate.

The first embodiment has been described for an example in which the fixing guide 24 journals the shaft 12*a* slidably in the axial direction and inclinably through rotation control. As illustrated in FIG. 16, preferably, the sheet conveying device 10 further includes a rotary plate 27 that rotates in operative association with the shift unit 20 during the rotation control.

The example illustrated in FIG. 16 includes the rotary plate 27 and a guide unit (not illustrated) disposed at a lower portion of the shift unit 20, the guide unit for guiding the shift motion of the shift unit 20. The guide unit is disposed in parallel with the shaft 12*a* so that the shift unit 20 is slidable in the direction orthogonal to the conveying direction during non-rotational control (e.g. FIG. 5) of the shift unit 20. The guide unit may include, for example, a protrusion disposed on the underside of the shift unit 20 and a recess formed in the rotary plate 27. The foregoing arrangement allows the shift unit 20 to be stably slidable (shift amount adjustment) even during an angle adjustment.

Preferably, a guide plate 25 may also be provided in order to reliably support rotation of the rotary plate 27.

According to the embodiments, it enables, with a simple arrangement, the shift unit that supports the gate members and the pairs of registration rollers to be moved in the direction orthogonal to the sheet conveying direction and the gate angle to be adjusted.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet conveying device comprising:

a shift unit including a gate member configured to align a recording medium being conveyed thereto by causing a leading end of the recording medium to abut against the gate member so that part of the recording medium bends to form a curved portion, a pair of registration rollers configured to convey the recording medium aligned by the gate member at a set timing, the pair of registration rollers including a driving roller and a driven roller, the driving roller having a rotating shaft coaxial with a rotational central shaft of the gate member, and a drive transmitting unit configured to transmit rotational drive from a drive unit to the driving roller, the drive transmitting unit being disposed on an end side of the rotating shaft of the driving roller;

a shift control unit configured to hold the shift unit so that the shift unit is movable in a direction orthogonal to a conveying direction of the recording medium; and a rotation control unit configured to move the rotating shaft of the driving roller and the rotational central shaft of the gate member at a set angle relative to an orthogonal direction of the sheet conveying direction so that the shift unit is rotatable about the drive transmitting unit as pivotal center in the conveying direction of the recording medium.

2. The sheet conveying device according to claim 1, further comprising a fixing unit configured to hold the shift unit rotated in the conveying direction of the recording medium so as to allow the shift unit to move by the shift control unit.

3. The sheet conveying device according to claim 1, wherein the drive transmitting unit includes a first gear for driving the rotating shaft of the driving roller, the sheet conveying device further includes a second gear for transmitting a drive force to the first gear, the first gear and the second gear each are a spur gear, and a shifting center is formed at an engagement portion in the first gear with the second gear at one side of the sheet conveying device.

4. The sheet conveying device according to claim 1, wherein at least one of a shift amount of the shift unit controlled by the shift control unit and a rotation amount of the shift unit controlled by the rotation control unit are to be set manually.

5. The sheet conveying device according to claim 1, further comprising:

a detector configured to detect a position of the recording medium in a direction orthogonal to the conveying direction of the recording medium, the detector being disposed downstream of the shift unit in the conveying direction; and a shift control driving unit configured to control the shift control unit, wherein the shift control driving unit calculates a shift amount of the shift unit based on a value detected by the detector and moves the shift unit by the calculated shift amount.

6. The sheet conveying device according to claim 5, further comprising a rotation control driving unit configured to control the rotation control unit, wherein the rotation control driving unit calculates an angle adjustment amount of the shift unit based on the value detected by the detector and rotates the shift unit by the calculated angle.

7. The sheet conveying device according to claim 6, wherein the shift control driving unit calculates the shift amount by adding or subtracting a deviation amount in the direction orthogonal to the conveying direction of the recording medium, the deviation amount arising from the rotation of the shift unit based on the angle adjustment amount calculated by the rotation control driving unit.

8. The sheet conveying device according to claim 1, further comprising:

a pair of paper feeding rollers configured to convey the recording medium, the pair of paper feeding rollers being disposed upstream of the shift unit in the conveying direction; and a pair of timing rollers configured to convey the recording medium, the pair of timing rollers being disposed downstream of the shift unit in the conveying direction.

9. An image forming apparatus comprising the sheet conveying device according to claim 1.

10. A shift unit, comprising:

a gate member configured to align a recording medium being conveyed thereto by causing a leading end of the recording medium to abut against the gate member so that part of the recording medium bends to form a curved portion, a pair of registration rollers configured to convey the recording medium aligned by the gate member at a set timing, the pair of registration rollers including a driving roller and a driven roller, the driving roller having a rotating shaft coaxial with a rotational central shaft of the gate member, and a drive transmitting unit configured to transmit rotational drive from a drive unit to the driving roller, the drive transmitting unit being disposed on an end side of the rotating shaft of the driving roller;

a shift control unit configured to hold the shift unit so that the shift unit is movable in a direction orthogonal to a conveying direction of the recording medium; and a rotation control unit configured to move the rotating shaft of the driving roller and the rotational central shaft of the gate member at a set angle relative to an orthogonal direction of the sheet conveying direction so that the shift unit is rotatable about the drive transmitting unit as pivotal center in the conveying direction of the recording medium; and a detector configured to detect a position of the recording medium in a direction orthogonal to the conveying direction of the recording medium, the detector being disposed downstream of the shift unit in the conveying direction; and a rotation control driving unit configured to calculate an angle adjustment amount of the shift unit based on the value detected by the detector and rotates the shift unit by the calculated angle.

11. A method of shifting a sheet conveying device, the sheet conveying device includes a shift unit having a gate member, a pair of registration rollers with a driving roller and a driven roller, a drive transmitting unit, a shift control unit, and a rotational control unit, the method comprising:

aligning a recording medium by causing a leading end of a recording medium to abut against the gate member so that part of the recording medium bends to form a curved portion;

conveying the recording medium aligned by the gate member at a set timing, the driving roller includes a rotating shaft coaxial with a rotational central shaft of the gate member;

transmitting a rotational drive from the drive unit to the driving roller, the drive transmitting unit being disposed on an end side of the rotating shaft of the driving roller;

holding the shift unit so that the shift unit is movable in a direction orthogonal to a conveying direction of the recording medium; and moving the rotating shaft of the driving roller and the rotational central shaft of the gate at a set angle relative to an orthogonal direction of the sheet conveying direction so that the shift unit is rotatable about the drive transmitting unit as pivotal center in the conveying direction of the recording medium.

* * * * *